US011117702B2

(12) United States Patent
Esseny et al.

(10) Patent No.: US 11,117,702 B2
(45) Date of Patent: Sep. 14, 2021

(54) COLLAPSIBLE TISSUE BOX ASSEMBLY

(71) Applicants: Sylvia Esseny, Pahrump, NV (US); Henry Hurlbut, Pahrump, NV (US)

(72) Inventors: Sylvia Esseny, Pahrump, NV (US); Henry Hurlbut, Pahrump, NV (US)

( * ) Notice: Subject to any disclaimer, the term of this patent is extended or adjusted under 35 U.S.C. 154(b) by 199 days.

(21) Appl. No.: 16/399,446

(22) Filed: Apr. 30, 2019

(65) Prior Publication Data

US 2020/0346815 A1 Nov. 5, 2020

(51) Int. Cl.

| | |
|---|---|
| ***B65D 5/02*** | (2006.01) |
| ***B65D 5/355*** | (2006.01) |
| ***B65D 83/08*** | (2006.01) |
| ***B65D 5/54*** | (2006.01) |
| ***B65D 5/72*** | (2006.01) |

(52) U.S. Cl.

CPC ..... *B65D 5/0005* (2013.01); *B65D 5/54* (2013.01); *B65D 5/72* (2013.01); *B65D 83/0805* (2013.01)

(58) Field of Classification Search

CPC ..... B65D 5/0005; B65D 5/54; B65D 5/72; B65D 83/0805

USPC ..... 229/101.2

See application file for complete search history.

(56) References Cited

U.S. PATENT DOCUMENTS

| | | | | |
|---|---|---|---|---|
| 3,224,633 | A * | 12/1965 | Dayton | B65D 5/0005 221/48 |
| 5,065,936 | A | 11/1991 | King | |
| 7,172,093 | B2 | 2/2007 | Bando | |
| 2005/0150801 | A1 | 7/2005 | Tippey | |
| 2005/0173269 | A1 * | 8/2005 | Lebras | B65D 71/0022 206/170 |
| 2007/0194035 | A1 | 8/2007 | Kivatisky | |
| 2017/0175336 | A1 * | 6/2017 | Hirata | B65D 5/0227 |

* cited by examiner

*Primary Examiner* — Stephen J Castellano

(57) ABSTRACT

A collapsible tissue box assembly for defining a vertically collapsible tissue box includes a panel that has a plurality of fold lines thereon thereby facilitating the panel to be formed into a tissue box. The panel has a pair of tear away elements thereon that collectively define an upper half and a lower half of the tissue box. Each of the tear away elements is removable from the tissue box. In this way the upper half can to be lowered around the lower half to enhance access to tissues in the lower half of the tissue box.

10 Claims, 5 Drawing Sheets

COLLAPSIBLE TISSUE BOX ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to tissue box devices and more particularly pertains to a new tissue box device for defining a vertically collapsible tissue box.

BRIEF SUMMARY OF THE INVENTION

An embodiment of the disclosure meets the needs presented above by generally comprising a panel that has a plurality of fold lines thereon thereby facilitating the panel to be formed into a tissue box. The panel has a pair of tear away elements thereon that collectively define an upper half and a lower half of the tissue box. Each of the tear away elements is removable from the tissue box. In this way the upper half can to be lowered around the lower half to enhance access to tissues in the lower half of the tissue box.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
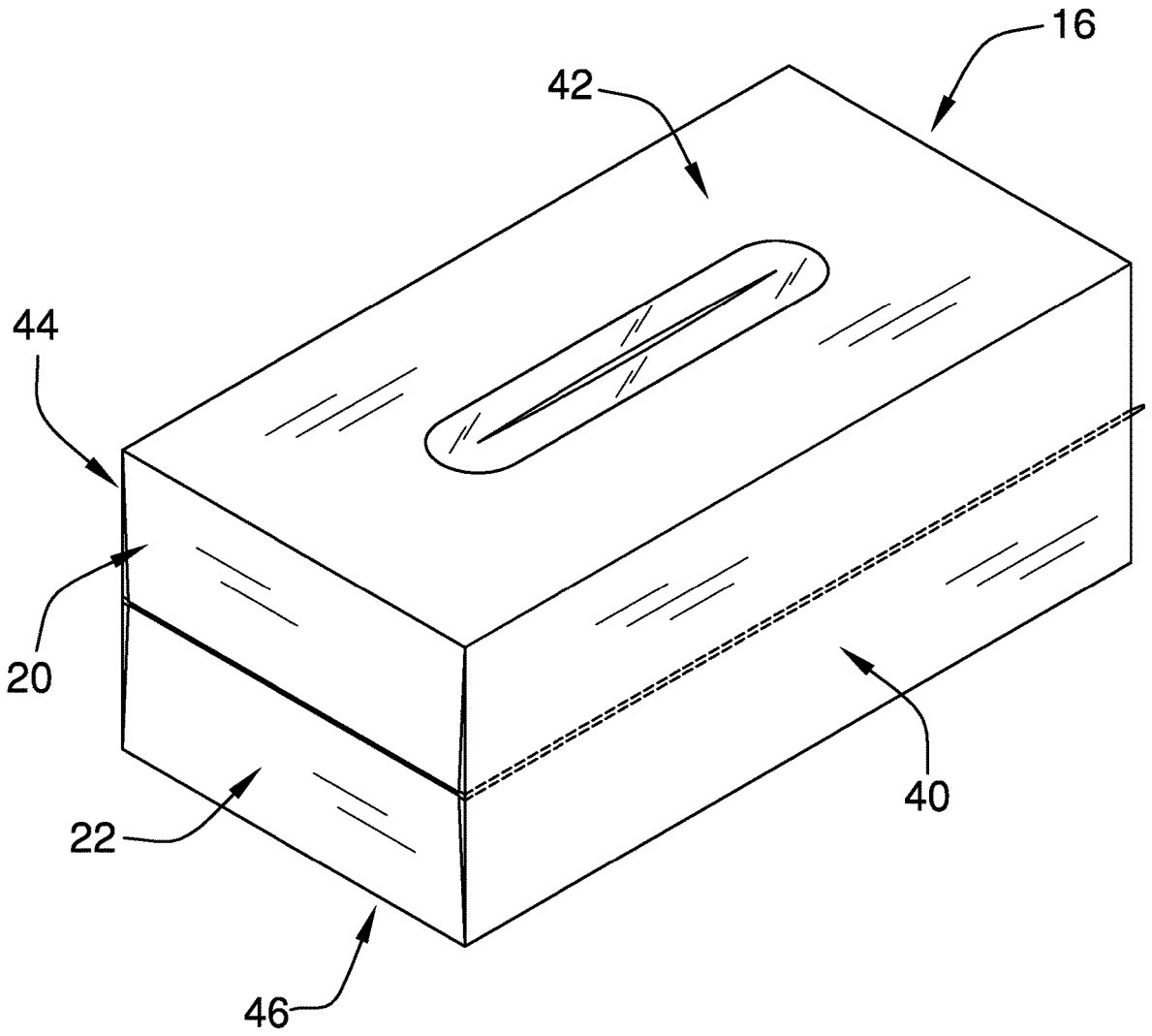
FIG. 1 is a top perspective view of a collapsible tissue box assembly according to an embodiment of the disclosure.
Figure 2:
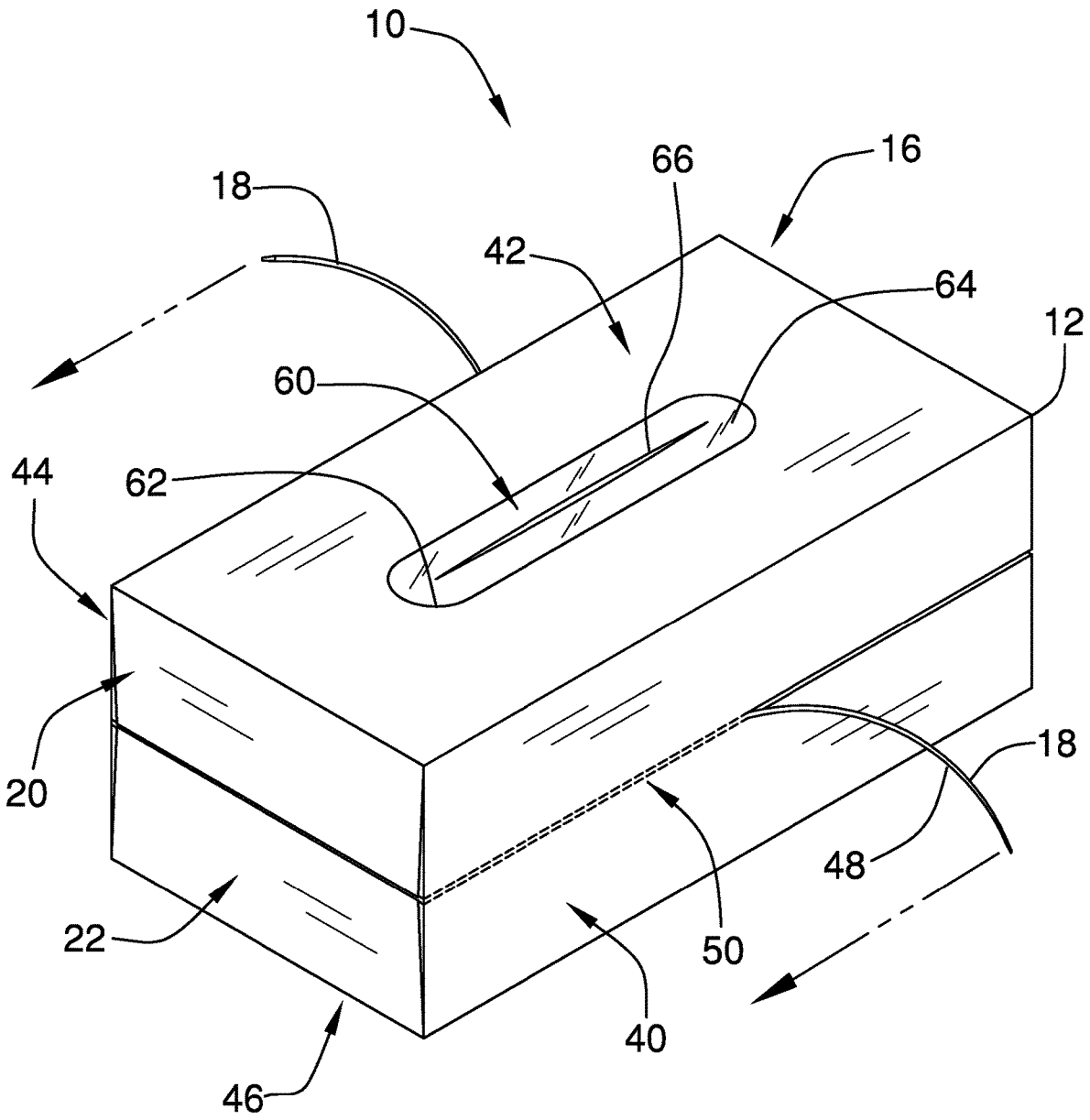
FIG. 2 is a perspective view of an embodiment of the disclosure showing a pair of tear away elements each being removed from a tissue box.
Figure 3:
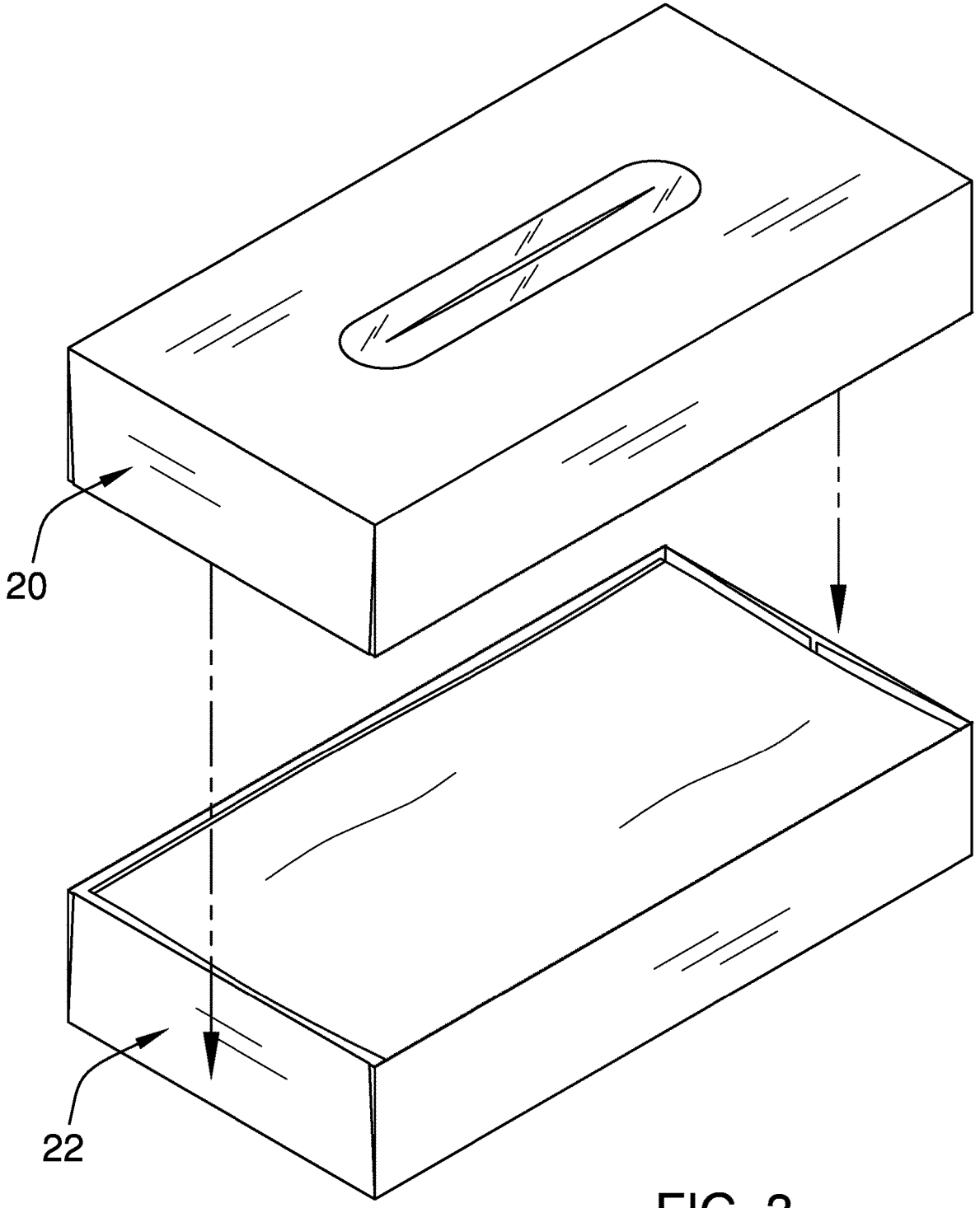
FIG. 3 is an exploded perspective view of an embodiment of the disclosure showing an upper half of a tissue box being lowered onto a lower half of a tissue box.
Figure 4:
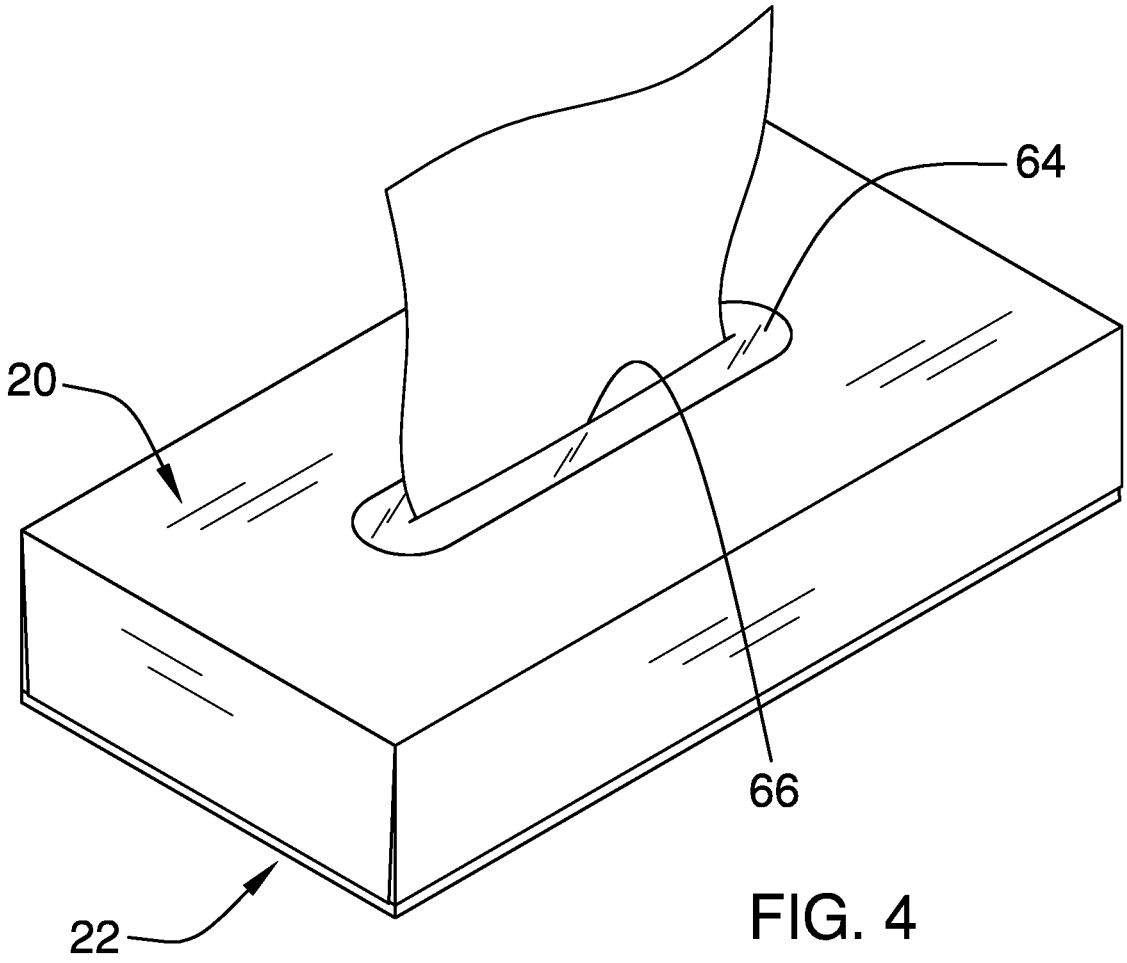
FIG. 4 is a perspective in-use view of an embodiment of the disclosure having been vertically collapsed.
Figure 5:
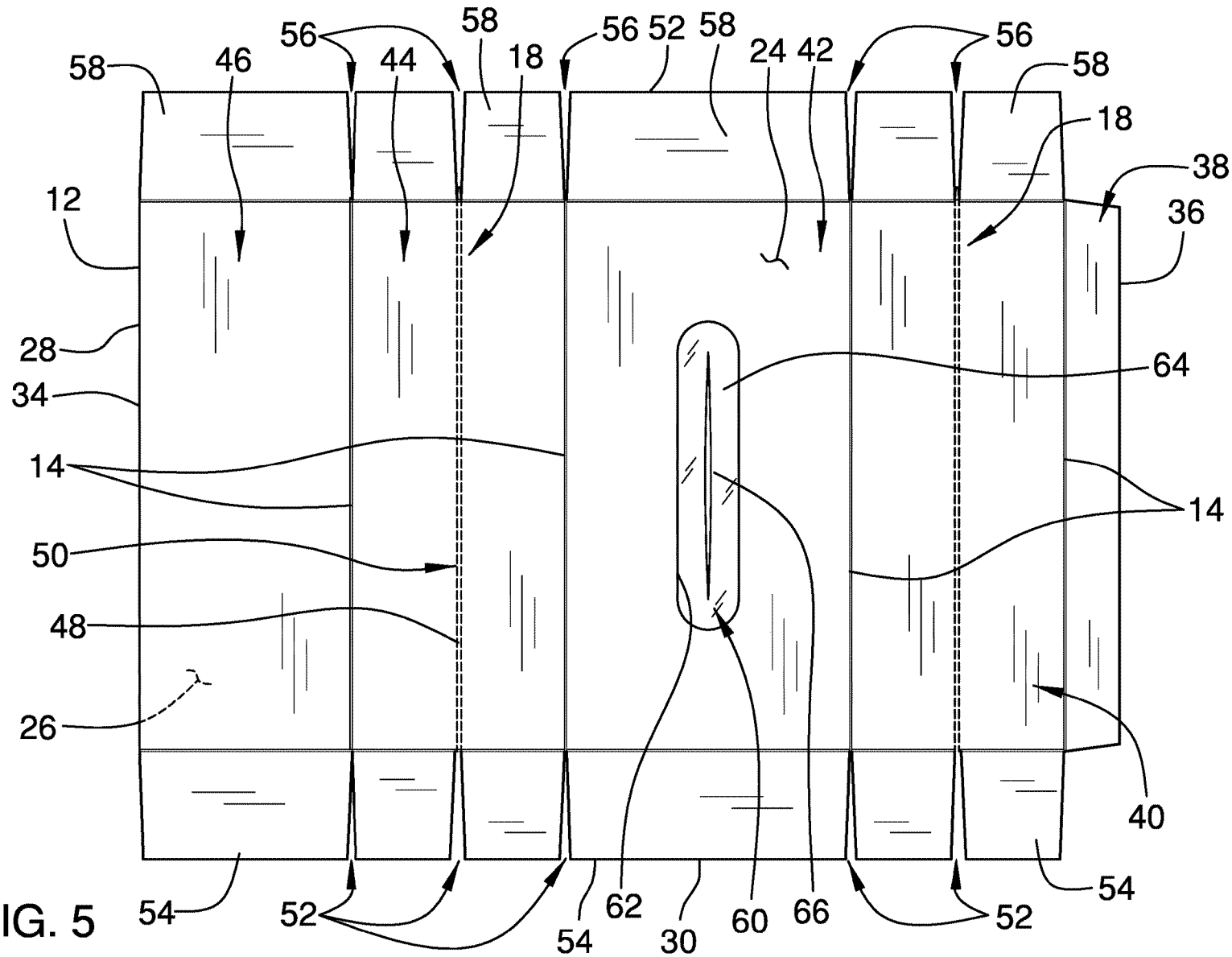
FIG. 5 is a top view of an embodiment of the disclosure in an unfolded and unassembled state.

With reference now to the drawings, and in particular to FIGS. 1 through 5 thereof, a new tissue box device embodying the principles and concepts of an embodiment of the disclosure and generally designated by the reference numeral 10 will be described.

As best illustrated in FIGS. 1 through 5, the collapsible tissue box assembly 10 generally comprises a panel 12 that has a plurality of fold lines 14 thereon thereby facilitating the panel 12 to be formed into a tissue box 16. The panel 12 has a pair of tear away elements 18 thereon that collectively define an upper half 20 and a lower half 22 of the tissue box 16. Each of the tear away elements 18 is removable from the tissue box 16 thereby facilitating the upper half 20 to be lowered around the lower half 22. In this way the tissue box 16 enhances access to tissues in the lower half 22 of the tissue box 16.

The panel 12 has a first surface 24, a second surface 26 and a perimeter edge 28 extending therebetween. The perimeter edge 28 has a front side 30, a back side 32, a first lateral side 34 and a second lateral side 36. Each of the fold lines 14 extends between the front side 30 and the back side 32, and the fold lines 14 are spaced apart from each other and are distributed between the first 34 and second 36 lateral sides. The fold lines 14 define a primary flap 38 that is coextensive with the second lateral side 36. The fold lines 14 define a first lateral portion 40 of the tissue box 16 extending from the primary flap 38 toward the first lateral side 34.

The fold lines 14 define a top portion 42 of the tissue box 16 extending from the first lateral portion 40 toward the first lateral side 34. Additionally, the fold lines 14 define a second lateral portion 44 of the tissue box 16 extending from the top portion 42 toward the first lateral side 34. The fold lines 14 define a bottom portion 46 of the tissue box 16 extending between the second lateral portion 44 and the first lateral side 34. Each of the tear away elements 18 extends between the front 30 and back 32 sides and each of the tear away elements 18 is centrally positioned on a respective one of the first 40 and second 44 lateral portions of the tissue box 16. Additionally, each of the tear away elements 18 comprises a strip 48 that is defined by perforations 50 that extending through the respective first 40 and second 44 lateral portions of the tissue box 16.

The panel 12 has a plurality of first cuts 52 each extending from the front side 30 toward the back side 32. Moreover, each of the first cuts 52 is aligned with a respective one of the fold lines 14 and a respective one of the tear away elements 18. Each of the first cuts 52 defines a respective one of a plurality of first flaps 54. The panel 12 has a plurality of second cuts 56 each extending from the back side 32 toward the front side 30. Additionally, each of the second cuts 56 is aligned with a respective one of the fold lines 14 and a respective one of the tear away elements 18. Each of the second cuts 56 defines a respective one of a plurality of second flaps 58 and each of the second flaps 58 is aligned with a respective one of the first flaps 54.

The panel 12 has a slot 60 extending through the first 24 and second 26 surfaces and the slot 60 is centrally positioned on the top portion 42 of the tissue box 16. Moreover, the slot 60 facilitates access to the tissues that are positioned in the tissue box 16. The slot 60 is oriented to extend along a line that extends between the front 30 and back 32 sides of the perimeter edge 28 of the panel 12 and the slot 60 has a bounding edge 62. A membrane 64 is coupled to the bounding edge 62 of the slot 60 such that the membrane 64 covers the slot 60. The membrane 64 has a slit 66 therein thereby facilitating the tissues contained in the tissue box 16 to be drawn through the slit 66.

In use, the panel 12 is folded along each of the fold lines 14 to define the tissue box 16. Each of the first 54 and second 58 flaps is folded inwardly when panel 12 is folded along the fold lines 14. In this way the tissue box 16 is formed for containing tissues. Each of the tear away elements 18 is torn away from the tissue box 16 when the tissues in the tissue box 16 become depleted to the point that the tissues cannot be accessed through the slot 60. Thus, the upper half 20 of the tissue box 16 can be lowered around the lower half 22 of the tissue box 16. In this way the slot 60 is positioned closer to the tissues in the lower half 22 of the tissue box 16 the enhance accessing the tissues in the lower half 22 of the tissue box 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A collapsible tissue box assembly being configured to be vertically collapsed to enhance access to tissues at the bottom of a tissue box, said assembly comprising:

a panel having a plurality of fold lines thereon thereby facilitating said panel to be formed into a tissue box, said panel having a pair of tear away elements thereon that collectively define an upper half and a lower half of said tissue box, each of said tear away elements being removable from said tissue box thereby facilitating said upper half to be lowered around said lower half wherein said tissue box is configured to enhance access to tissues in said lower half of said tissue box, wherein said panel has a first surface, a second surface and a perimeter edge extending therebetween, perimeter edge having a front side, a back side, a first lateral side and a second lateral side, each of said fold lines extending between said front side and said back side, said fold lines being spaced apart from each other and being distributed between said first and second lateral sides, wherein said panel has a plurality of first cuts each extending from said front side toward said back side, each of said first cuts being aligned with one of either a respective one of said fold lines or a respective one of said tear away elements, each of said first cuts defining a respective one of a plurality of first flaps, wherein said panel has a plurality of second cuts each extending from said back side toward said front side, each of said second cuts being aligned with one of either a respective one of said fold lines or a respective one of said tear away elements, each of said second cuts defining a respective one of a plurality of second flaps, each of said second flaps being aligned with a respective one of said first flaps.

2. The assembly according to claim 1, wherein said fold lines define a primary flap being coextensive with said second lateral side.

3. The assembly according to claim 2, wherein said fold lines define a first lateral portion of said tissue box extending from said primary flap toward said first lateral side.

4. The assembly according to claim 3, wherein said fold lines define a top portion of said tissue box extending from said first lateral portion toward said first lateral side.

5. The assembly according to claim 4, wherein said fold lines define a second lateral portion of said tissue box extending from said top portion toward said first lateral side.

6. The assembly according to claim 5, wherein said fold lines define a bottom portion of said tissue box extending between said second lateral portion and said first lateral side.

7. The assembly according to claim 6, wherein each of said tear away elements extends between said front and back sides, each of said tear away elements being centrally positioned on a respective one of said first and second lateral portions of said tissue box.

8. The assembly according to claim 1, wherein said panel has a slot extending through said first and second surfaces, said slot being centrally positioned on said top portion of said tissue box wherein said slot is configured to facilitate access to the tissues positioned in said tissue box, said slot being oriented to extend along a line extending between said front and back sides of said perimeter edge of said panel, said slot having a bounding edge.

9. The assembly according to claim 8, further comprising a membrane being coupled to said bounding edge of said slot such that said membrane covers said slot, said membrane having a slit therein wherein said slit is configured to have the tissues contained in said tissue box being drawn therethrough.

10. A collapsible tissue box assembly being configured to be vertically collapsed to enhance access to tissues at the bottom of a tissue box, said assembly comprising:

a panel having a plurality of fold lines thereon thereby facilitating said panel to be formed into a tissue box, said panel having a pair of tear away elements thereon that collectively define an upper half and a lower half of said tissue box, each of said tear away elements being removable from said tissue box thereby facilitating said upper half to be lowered around said lower half wherein said tissue box is configured to enhance access to tissues in said lower half of said tissue box, said panel having a first surface, a second surface and a perimeter edge extending therebetween, perimeter edge having a front side, a back side, a first lateral side and a second lateral side, each of said fold lines extending between said front side and said back side, said fold lines being spaced apart from each other and being distributed between said first and second lateral sides, said fold lines defining a primary flap being coextensive with said second lateral side, said fold lines defining a first lateral portion of said tissue box extending from said primary flap toward said first lateral side, said fold lines defining a top portion of said tissue box extending from said first lateral portion toward said first lateral side, said fold lines defining a second lateral portion of said tissue box extending from said top portion toward said first lateral side, said fold lines defining a bottom portion of said tissue box extending between said second lateral portion and said first lateral side, each of said tear away elements extending between said front and back sides, each of said tear away elements being centrally positioned on a respective one of said first and second lateral portions of said tissue box, said panel having a plurality of first cuts each extending from said front side toward said back side, each of said first cuts being aligned with one of either a respective one of said fold lines or a respective one of said tear away elements, each of said first cuts defining a respective one of a plurality of first flaps, said panel having a plurality of second cuts each extending from said back side toward said front side, each of said second cuts being aligned with one of either a respective one of said fold lines or a respective one of said tear away elements, each of said second cuts defining a respective one of a plurality of second flaps, each of said second flaps being aligned with a respective one of said first flaps, said panel having a slot extending through said first and second surfaces, said slot being centrally positioned on said top portion of said tissue box wherein said slot is configured to facilitate access to the tissues positioned in said tissue box, said slot being oriented to extend along a line extending between said front and back sides of said perimeter edge of said panel, said slot having a bounding edge; and a membrane being coupled to said bounding edge of said slot such that said membrane covers said slot, said membrane having a slit therein wherein said slit is configured to have the tissues contained in said tissue box being drawn therethrough.

* * * * *